US007652866B2

(12) United States Patent
Barnard et al.

(10) Patent No.: US 7,652,866 B2
(45) Date of Patent: Jan. 26, 2010

(54) FLEXIBLE CONDUCTIVE STATIC CONTROL BRUSH ASSEMBLY

(75) Inventors: Michael P. Barnard, Portland, ME (US); Adam H. Willwerth, North Yarmouth, ME (US); Jeffrey W. Richardson, Otisfield, ME (US); Mario E. Blais, Greene, ME (US); Linda Heaward, Oxford, ME (US)

(73) Assignee: Illinois Tool Works, Glenview, IL (US)

( * ) Notice: Subject to any disclaimer, the term of this patent is extended or adjusted under 35 U.S.C. 154(b) by 373 days.

(21) Appl. No.: 11/507,282

(22) Filed: Aug. 21, 2006

(65) Prior Publication Data

US 2007/0039110 A1 Feb. 22, 2007

Related U.S. Application Data

(60) Provisional application No. 60/710,229, filed on Aug. 22, 2005.

(51) Int. Cl.

| | |
|---|---|
| ***A46B 3/08*** | (2006.01) |
| ***A46B 3/18*** | (2006.01) |
| *A46D 3/05* | (2006.01) |

(52) U.S. Cl. ..... 361/221; 300/21; 300/8; 15/190; 15/176.6

(58) Field of Classification Search ..... 399/353, 399/390; 206/362; 361/221; 15/190, 176.6; 300/8; 434/94

See application file for complete search history.

(56) References Cited

U.S. PATENT DOCUMENTS

| | | | | |
|---|---|---|---|---|
| 4,039,079 | A * | 8/1977 | Laughton | 206/461 |
| 4,690,277 | A * | 9/1987 | Lewis, Jr. | 206/362.1 |
| 4,771,360 | A * | 9/1988 | Ayash | 361/221 |
| 4,889,228 | A * | 12/1989 | Gueret | 206/209 |
| 5,414,890 | A * | 5/1995 | Morando | 15/167.1 |
| 6,647,242 | B2 * | 11/2003 | Gagnon et al. | 399/390 |

* cited by examiner

*Primary Examiner*—Daniel J Colilla
(74) *Attorney, Agent, or Firm*—Setter Roche LLP

(57) ABSTRACT

A flexible conductive static control brush assembly includes first and second brushes disposed on a common backing strip. Each brush includes a plurality of filaments disposed inwardly from opposite edges of the backing strip. Bands overlie outer end portions of the filaments adjacent edges of the backing strip, with the bands covering only a portion of each filament length. The backing strip includes parting lines for tearing to remove an intermediate portion of the backing strip between the brushes to expose the filaments.

20 Claims, 2 Drawing Sheets

FLEXIBLE CONDUCTIVE STATIC CONTROL BRUSH ASSEMBLY

CROSS-REFERENCE TO RELATED APPLICATIONS

The present regular United States Patent Application claims the benefits of U.S. Provisional Application Ser. No. 60/710,229 filed on Aug. 22, 2005.

FIELD OF THE INVENTION

The present invention relates generally to static control brush assemblies, and, more particularly, the invention pertains to flexible static control brush assemblies provided as an elongated strip or web.

BACKGROUND OF THE INVENTION

Flexible conductive brush assemblies are known for various purposes. For example, U.S. Pat. No. 6,647,242 "FLEXIBLE CONDUCTIVE PLASTIC STATIC CONTROL DEVICE" discloses a static control device for media handling systems, such as printers, copiers and the like. Bundles of fine fibers are provided in a non-contacting, ionization arrangement for dissipating static charge from the printer, copier or the like.

In a known design, a flexible conductive plastic static control brush has an adhesive backing on a carrier strip, and a removable pull strip protects the adhesive strip during packaging and handling. Upon removing the protective strip, the adhesive layer is exposed, and the brush assembly can be adhered in place. The protective layer over the adhesive strip not only covers the adhesive layer, but also protects the very fine, hair-like filaments of the brush assembly during handling and installation.

Known prior assemblies have performed satisfactorily for their intended purposes. However, it is not always desirable to have exposed adhesive on the brush assembly during installation. For example, the brush assembly may be secured in its operative installation by a clamping means or other holder in which the assembly is secured. Having an exposed adhesive layer may be detrimental to final assembly, making it difficult to position the device due to the natural tackiness of the adhesive layer interfering with the proper placement of the brush.

It remains desirable that the fine, hair-like filaments used in the fiber bundles are protected from damage during transportation, handling and installation of the device. However, any protective structure desirably should be removed easily, to facilitate final installation without prolonging unduly the final preparation of the strip for installation.

SUMMARY OF THE INVENTION

The present invention provides a brush assembly with a backing strip having a parting line, such as a perforated line, along which the backing strip can be torn for removing a portion of the backing strip that protects exposed filaments of the brush assembly.

In one aspect thereof, the present invention provides a brush assembly with a plurality of brush filaments; a band having a width covering a portion of each filament less than the entire filament; and a backing strip secured to the band and extending on an opposite side of the filaments from the band. The backing strip covers a substantial portion the filament lengths not covered by the band. A parting line in the backing strip is adapted for tearing to remove a portion of the backing strip to expose the filaments from both sides thereof.

In another aspect thereof, the present invention provides a flexible conductive brush assembly with a backing strip, a plurality of conductive filaments on the backing strip extending toward one another from opposite edges of the backing strip; a first band overlying an outer portion of the filaments along one edge of the backing strip; and a second band overlying an outer portion of the filaments along the opposite edge of the backing strip. Inner portions of the filaments remain uncovered by the first and second bands. First and second parting lines in the backing strip are adapted for tearing to separate the assembly into first and second brushes and an intermediate portion of the backing strip between the parting lines.

In a still further aspect thereof, the present invention provides a brush assembly with a first brush having a group of first filaments and a first band partially cover the first filaments; a second brush having a group of second filaments and a second band partially covering the second filaments; and a common backing strip for the first brush and the second brush. The backing strip has a first side portion substantially opposed to the first band, a second side portion substantially opposed to the second band, and an intermediate portion detachably connecting the first and second side portions.

An advantage of the present invention is providing a flexible conductive brush assembly that is easy to handle and install.

Another advantage of the present invention is providing a flexible conductive static control brush in which fiber bundles are protected during shipping and handling but readily exposable for final installation.

In a still further aspect thereof, the present invention provides a static control brush assembly in an elongated flexible strip having a backing layer that is partly removable to protect fiber filaments before removal and expose the fiber filaments for final installation.

Other features and advantages of the invention will become apparent to those skilled in the art upon review of the following detailed description, claims and drawings in which like numerals are used to designate like features.

Figure 1:
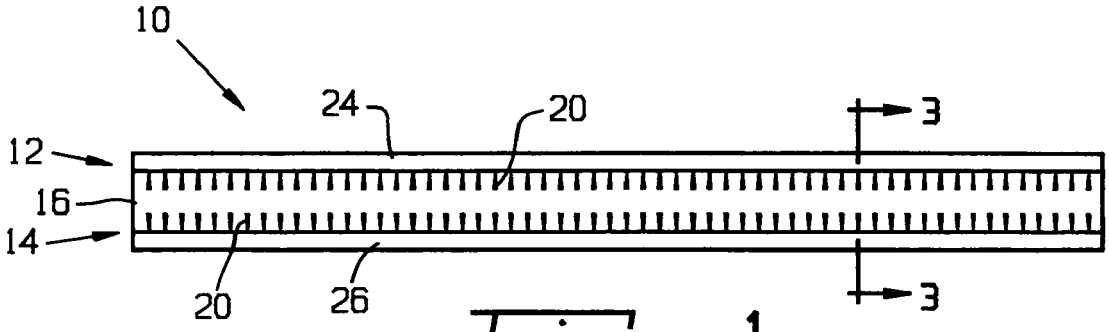
FIG. 1 is a plan view of a flexible conductive static control brush assembly in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, numeral 10 designates a flexible conductive static control brush assembly in accordance with the present invention. Assembly 10 is in the nature of a strip, which may be provided in specified short lengths or in an elongated length wound on a spool from which desirable lengths can be cut. Assembly 10 includes a first brush 12 and a second brush 14 on a backing strip 16, with brushes 12 and 14 facing each other.

Figure 2:
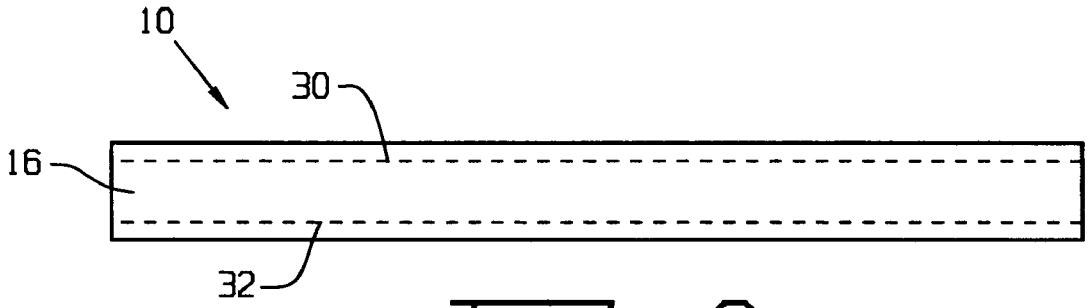
FIG. 2 is a plan view of the strip shown in FIG. 1, illustrating the side opposite the side shown in FIG. 1.
Figure 3:
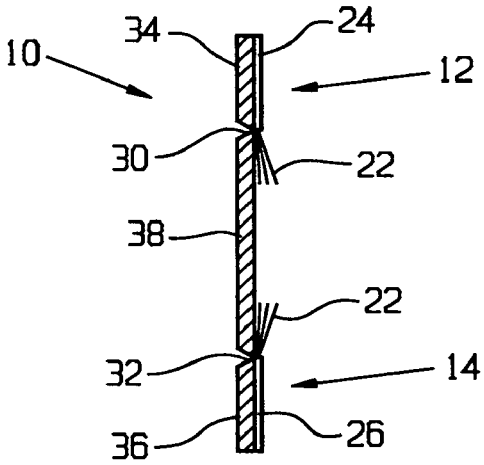
FIG. 3 is a cross-sectional view of the flexible conductive static control brush assembly shown in FIGS. 1 and 2.

As seen most clearly in FIG. 3, backing strip 16 is of sufficient width to span the distance from an outside edge of brush 12 to an outside edge of brush 14 and in intermediate space therebetween. Thus, backing strip 16 provides a convenient way for carrying and handling brushes 12 and 14 and protects brushes 12 and 14 from at least one side thereof. On a coil or spool supply wrapping can be done with backing strip 16 facing outwardly so that brushes 12 and 14 are protected, and only the side of backing strip 16 illustrated in FIG. 2 is exposed.

Brushes 12 and 14 are similarly constructed and include a plurality of bundles 20 each having a plurality of filaments 22 therein. For purposes of clarity in the drawings, only two bundles 20, and not all bundles 20 have been identified with a reference number in FIG. 1. Accordingly, one bundle 20 is identified with a reference number 20 in first brush 12 and one bundle 20 is identified with a reference number 20 in second brush 14. Further, only two filaments 22, and not all filaments 22 have been identified with a reference number in FIG. 3. Accordingly, one filament 22 is identified with a reference number 22 in first brush 12, and one filament 22 is identified with a reference number 22 and second brush 14. Also, it should be understood that filaments 22 need not be provided in discrete bundles 20. Instead, filaments 22 can be provided as an elongated row of filaments of desired density for the application.

Filaments 22 can be carbon fiber, stainless steel fiber, conductive acrylic fiber or any other conductive fiber type filament that can be provided with diameters sufficiently small to induce ionization when in the presence of an electrical field. Alternatively, filaments 22 can be of greater diameter and provided in a contacting type arrangement when installed. The present invention works equally well for protecting both fine filaments 22 useful in ionizing applications and thicker filaments 22 used in contacting arrangements. Further, the present invention can be used for brush assemblies used for purposes other than static control.

On the upper surface of assembly 10, as shown in FIG. 1, a first elongated band 24 of flexible plastic or other suitable material overlies an outer end portion of bundles 20 in first brush 12, and a second elongated band 26 of flexible plastic or other suitable material overlies an outer end portion of bundles 20 in second brush 14. Thus, one end of each bundle 20 is captured between backing strip 16 and either band 24 or band 26. Suitable adhesive or the like can be used between bands 24, 26 and backing strip 16 to secure the bands and backing strip to each other and to secure bundles 20 of filaments 22 therebetween. A distal portion of each bundle 20 or filament 22 in first brush 12 extends beyond band 24, and a distal portion of each bundle 20 or filament 22 in second brush 14 extends beyond band 26. In assembly 10, the distal portions of brushes 12 and 14 extend toward one another in a center portion of the assembly, between bands 24 and 26.

With reference now to FIG. 2, backing strip 16 includes first and second parting lines 30, 32 substantially in line with the inner edges of bands 24, 26. First and second parting lines 30, 32 can be a series of perforations or slits extending through the thickness of backing strip 16 or can be a thinned or partially cut line in backing strip 16.

Backing strip 16 can be torn along one or both parting lines 30, 32 to separate brushes 12 and 14 by dividing backing strip 16 into three portions, a first backing strip outer portion 34 in substantial opposed position with first band 24, a second backing strip outer portion 36 in substantial opposed position with band 26 and an intermediate portion 38 spanning the area between bands 24 and 26 on one side of the exposed distal ends of filaments 22. When separated, brushes 12 and 14 each include an outer edge portion of backing strip 16 of substantially similar width to bands 24, 26. After separation, filaments 22 in bundles 20 are exposed on both sides, in that intermediate portion 38 of backing strip 16 is separated from each first brush 12 and second brush 14. Intermediate portion 38 can be discarded.

Figure 4:
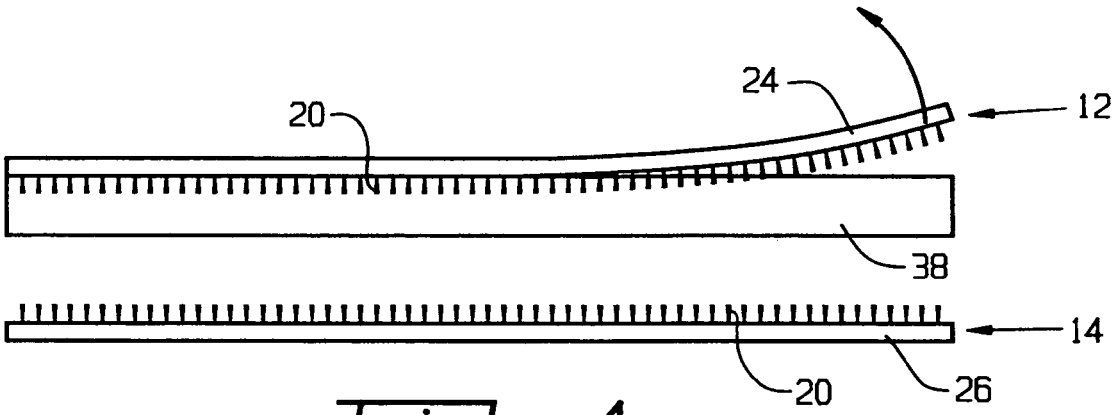
FIG. 4 is a perspective view of the assembly shown in FIG. 1, but illustrating one brush of the assembly detached for installation and the opposite side of the assembly being prepared for installation.

FIG. 4 illustrates assembly 10 partially prepared for use. Second brush 14 has been fully detached by tearing along second parting line 32. Second brush 14 is readily for use, with distal end portions of filament bundles 20 thereof being exposed. FIG. 4 further shows first brush 12 being detached from intermediate portion 38 of backing strip 16, with first parting line 30 only partly torn along its length. Upon completion of the tear along first parting line 30, intermediate portion 38 will be detached completely from each first brush 12 and second brush 14. First brush 12 will then also be readily for use, with distal end portions of filament bundles 20 therein exposed. Fully detached intermediate portion 38 may be discarded.

It should be understood that separation along parting lines 30, 32 can be performed manually; however, mechanical separation in automated machinery installing brushes 12 and 14 also can be used for tearing along parting lines 30, 32 as part of an installation process.

Figure 5:
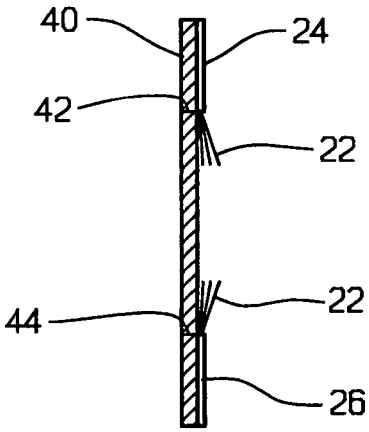
FIG. 5 is a cross-sectional view similar to that of FIG. 3 but illustrating a second embodiment of the present invention.

It should be understood further that other constructions can be used to facilitate tearing a backing strip along a desired path. For example, FIG. 5 illustrates a backing strip 40 having weakened lines 42, 44 along which backing strip 40 can be torn. Weakened lines 42, 44 can be formed as part of an extrusion or other process forming backing strip 40.

It should be understood still further that the general concepts of the present invention can be used for providing an assembly having only one brush, without an opposed brush as shown for brushes 12 and 14. Further, those skilled in the art will readily understand that a backing strip can be made sufficiently wide to accommodate more than two brushes in facing relationship. Additional parting lines can be provided so that three or more brushes can be provided on a single backing strip and separated from one another before final installation and use.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art. Various features of the invention are set forth in the following claims.

What is claimed is:

1. A brush assembly comprising:

a plurality of brush filaments;

a band having a width covering a portion of each filament less than the entire filament;

a backing strip secured to the band and extending on an opposite side of the filaments from the band, said backing strip covering a substantial portion of the filament lengths not covered by said band; and a parting line in said backing strip adapted for tearing and removing a portion of said backing strip to expose said filaments from both sides thereof;

wherein the plurality of brush filaments is non-removably secured between the band and the backing strip to form a brush.

2. The brush assembly of claim 1, said parting line being substantially parallel to an edge of said band.

3. The brush assembly of claim 2, said parting line being substantially aligned with an edge of said band.

4. The brush assembly of claim 1, said parting line being a perforate line.

5. The brush assembly of claim 1, said parting line having a lesser thickness relative to a thickness of adjacent areas of said backing strip.

6. The brush assembly of claim 1, including first and second bands along opposite edges of said backing strip and a plurality of filaments interposed between each said band and said backing strip, with distal end portions of said filaments extending outwardly beyond said bands toward one another over said backing strip between said bands.

7. The brush assembly of claim 6, said backing strip having first and second parting lines for separating said backing strip into a first outer portion in substantial opposed relationship to said first band, a second backing strip outer portion in substantial opposed relationship to said second band, and an intermediate portion between said first and second outer portions and completely detachable there from.

8. The brush assembly of claim 7, said first and second parting line being substantially aligned with inner edges of said first and second bands.

9. The brush assembly of claim 8, said first and second parting lines being perforations through said backing strip.

10. The brush assembly of claim 8, said first and second parting lines being weakened areas of said backing strip.

11. The brush assembly of claim 8, said filaments being grouped in bundles.

12. The brush assembly of claim 1, said filaments being grouped in bundles.

13. A flexible conductive brush assembly comprising:

a backing strip;

a first plurality of conductive filaments and a second plurality of conductive filaments secured along opposite edges of said backing strip, the first and second pluralities of conductive filaments extending toward one another from opposite edges of said backing strip;

a first band overlying an outer portion of said filaments along one edge of said backing strip;

a second band overlying an outer portion of said filaments along an opposite edge of said backing strip;

inner portions of said filaments being uncovered by said first and second bands; and first and second parting lines in said backing strip each adapted for tearing to separate said assembly into first and second brushes and an intermediate portion of said backing strip between said parting lines.

14. The conductive brush assembly of claim 13, said parting lines comprising perforations adjacent one another.

15. The conductive brush assembly of claim 13, said parting lines comprising weakened areas in said backing strip.

16. The conductive brush assembly of claim 13, said first and second parting lines being substantially aligned with inner edges of said first and second bands.

17. The conductive brush assembly of claim 13, said filaments being grouped in bundles.

18. A brush assembly comprising:

a first brush having a plurality of first filaments and a first band partially covering said first filaments along an outer end portion of the first filaments;

a second brush having a plurality of second filaments and a second band partially covering said second filaments along an outer end portion of the second filaments; and a common backing strip for said first brush and said second brush, said backing strip having a first outer portion substantially opposed to said first band, a second outer portion substantially opposed to said second band, and an intermediate portion detachably connecting said first and second outer portions, with distal end portions of said first and second filaments extending outwardly beyond said first and second bands, respectively, toward one another over said backing strip between said first and second bands.

19. The brush assembly of claim 18, said backing strip having first and second parting lines substantially aligned with inner edges of said first and second bands.

20. The brush assembly of claim 18, said filaments being grouped in bundles.

* * * * *

UNITED STATES PATENT AND TRADEMARK OFFICE

CERTIFICATE OF CORRECTION

PATENT NO. : 7,652,866 B2
APPLICATION NO. : 11/507282
DATED : January 26, 2010
INVENTOR(S) : Barnard et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 518 days.

Signed and Sealed this

Twenty-third Day of November, 2010

David J. Kappos

David J. Kappos
*Director of the United States Patent and Trademark Office*